US007946791B2

(12) United States Patent
Heindl et al.

(10) Patent No.: US 7,946,791 B2
(45) Date of Patent: May 24, 2011

(54) ARRANGEMENT OF SHEET-PILE COMPONENTS

(75) Inventors: Richard Heindl, Munich (DE); Rob Wendt, Rapid City, SD (US)

(73) Assignee: Pilepro, LLC, Rapid City, SD (US)

( * ) Notice: Subject to any disclaimer, the term of this patent is extended or adjusted under 35 U.S.C. 154(b) by 0 days.

(21) Appl. No.: 12/028,757

(22) Filed: Feb. 8, 2008

(65) Prior Publication Data

US 2009/0123237 A1 May 14, 2009

Related U.S. Application Data

(63) Continuation of application No. PCT/EP2006/007207, filed on Jul. 21, 2006.

(30) Foreign Application Priority Data

Aug. 9, 2005 (DE) ..... 10 2005 037 564
Jan. 2, 2006 (DE) ..... 10 2006 000 623

(51) Int. Cl.
*E02D 5/02* (2006.01)

(52) U.S. Cl. ..... 405/274

(58) Field of Classification Search ..... 405/274–281; D8/382

See application file for complete search history.

(56) References Cited

U.S. PATENT DOCUMENTS

| | | | | |
|---|---|---|---|---|
| 968,450 | A | 8/1910 | Conkling et al. | |
| 1,032,109 | A | 7/1912 | Buckingham | |
| 1,098,077 | A | 5/1914 | Annison | |
| 2,128,428 | A * | 8/1938 | Murray, Jr. | 405/278 |
| 3,688,508 | A | 9/1972 | Taylor | |
| D472,455 | S * | 4/2003 | Wall | D8/382 |
| 2008/0219776 | A1 | 9/2008 | Heindl | |

FOREIGN PATENT DOCUMENTS

| | | | |
|---|---|---|---|
| DE | 3907348 | A1 | 9/1990 |
| DE | 29718052 | U1 | 12/1997 |
| FR | 894627 | A | 12/1944 |
| JP | 60059228 | A * | 4/1985 |

OTHER PUBLICATIONS

International Search Report dated Oct. 30, 2006 from International Application PCT/EP2006/007207.

* cited by examiner

*Primary Examiner* — Sunil Singh

(74) *Attorney, Agent, or Firm* — Karl F. Milde, Jr.; Eckert Seamans Cherin & Mellott, LLC

(57) ABSTRACT

An arrangement of sheet-pile wall components includes two sheet-pile wall sections. The ends of the two sheet-pile wall sections are arranged. Their locks are hooked into two lock profiles of a connecting profile which is hooked via a third lock profile into the lock of an anchorage. The respective other ends of the sheet-pile wall sections are secured such that each of the two sheet-pile wall sections partially encloses a region. At least one of the lock profiles and the lock of the sheet-pile wall component of the anchorage in engagement therewith are configured in such a way that the lock profile of the connecting profile and the lock in engagement therewith are hooked one inside the other and grip around one another. As viewed in cross section, they bear on one another and are supported against one another by at least three points in at least one installed position.

15 Claims, 14 Drawing Sheets

ARRANGEMENT OF SHEET-PILE COMPONENTS

CROSS-REFERENCE TO RELATED APPLICATIONS

The present application is a continuation application of International Application No. PCT/EP2006/007207 filed Jul. 21, 2006 which claims priority to German Application Nos. 102005037564.2 filed Aug. 9, 2005 and 102006000623.2 filed Jan. 2, 2006. Each of the above-identified applications is expressly incorporated herein by reference in their entireties.

FIELD

The invention relates to an arrangement of sheet-pile wall components such as sheet piles and carrier elements.

BACKGROUND

An arrangement consisting of sheet-wall components of the type cited above is disclosed in U.S. Pat. No. 6,715,964. There, several adjacent sheet-pile sections which extend in an arc are joined by means of connecting profiles with sheet-pile sections held in the soil which serve as anchorages. The regions, which are called open cells, partly surrounded by the sheet-pile sections extending in an arc are filled with soil at least up to the level of the sheet-pile sections, whereas the outer regions which are isolated from the surrounded regions by the sheet-wall sections are filled with soil to a lower height. In this manner the sides of the sheet-wall sections that point in the outward direction partly protrude from the soil. This so-called open cell structure is used in harbor construction, for example, where the sides of the sheet-wall sections which face out form the harbor wall facing the water.

In the arrangement known from U.S. Pat. No. 6,715,964, sheet piles provided with simple locks in the form of header bars with an oval cross-section and C-shaped claw bars are used as the straight sheet-pile wall sections which extend in an arc. A star shaped profile at the end of which header bars with an oval cross-section are formed as locks serves as the connecting profile with which the sheet-pile wall sections are secured to the anchorage.

A disadvantage of the sheet-pile wall components used there is that the connecting profile joining the sheet-pile wall sections to the anchorages is under extremely high tensile forces particularly due to the soil pressure of the ground held back from the surrounding area.

In view of the above, an object of the present invention is to develop an arrangement in which the connecting profile joining the sheet-pile wall sections and the anchorage can also withstand extremely high tensile forces without the mutually engaged locks failing.

SUMMARY

The above-object is achieved according to the present invention by an arrangement of sheet-pile wall components such as sheet piles and carrier elements. The arrangement comprises two sheet-pile wall sections which include sheet-pile wall components extending in an arc or polygonal shape, and which are joined by means of locks. The sheet-pile wall components of the two sheet-pile wall sections provide on the ends of the two sheet-pile wall sections, which are arranged immediately adjacent one another, locks hooked into two lock profiles of a connecting profile. The provided connection is hooked via a third lock profile into the lock of an anchorage, and the sheet-pile wall components are provided on the respective other ends of the sheet-pile wall sections being secured in their positions such that each of the two sheet-pile wall sections partially encloses a region which serves as an open cell structure. The design at least one of the lock profiles of the connecting profile along with the lock of the sheet-pile wall components, or the anchoring being engaged with said profile in such a way that the lock profile of the connecting profile and the lock engaged therewith hook into one another and surround each other such that they are adjacent and mutually abutting, at least at three points, in at least one installation position when seen in cross-section.

According to the invention, it is disclosed that at least one of the lock profiles of the connecting profile and the lock of the sheet-pile wall components or the anchorage in engagement therewith be designed so that, when seen in cross-section, they form at least one so-called three point connection. The lock profile of the connecting profile and the lock of the sheet-pile wall components or anchorage engaged therewith are designed such that they surround each other and hook into each other in a mutual fashion in such a way that the locks adjoin and abut each another at least at three points when seen in cross-section. When tensile force impinges upon the sheet-pile wall components or the anchorage in the direction of contact, the two locks support each other at these three points in such a way that the tensile force is distributed over all three points of impact. This way the combination of a connecting profile and sheet-pile wall components or an anchorage in engagement therewith is able to withstand relatively high tensile forces which prevent the lock connections from becoming loose.

Further advantageous developments of the invention derive from the following description and the drawings.

It is particularly beneficial when the three-point connection described is formed between each lock profile of the connecting profile and the lock of the sheet-pile wall components in engagement therewith, respectively. In this manner the combination of connecting profile, sheet-pile wall components and anchorage is able to resist the influence of extremely high tensile forces without one of the lock profiles or one of the locks unintentionally opening.

Furthermore, in a particularly preferred embodiment of the arrangement according to the invention, a connecting profile is used wherein the two lock profiles at which the two sheet-pile wall components of the sheet-pile wall sections are hooked on have mirror-symmetrical contours relative to the superficial center of gravity of the connecting profile. This causes the tensile forces impinging upon the lock profiles of the connecting profile, as a result of the sheet-pile wall components, to come to bear on the connecting profile from mirror-symmetrical directions so that normally, when at least approximately equal tensile forces impinge upon the sheet-pile wall sections, the forces cancel each other out in part, and this prevents the connecting profile from being warped or twisted by forces of varying magnitude.

It is further proposed that the arrangement according to the invention be lengthened or expanded by hooking at least one of the two sheet-pile wall sections onto an additional connecting profile by means of the lock on the other end of the sheet-pile wall components of the section, and connecting the additional connecting profile to an additional sheet-pile wall section and an additional anchorage. By means of this modular construction, it is possible to build structures with correspondingly large dimensions because it is possible to anchor the free ends of the sheet-pile wall sections directly to carrier elements such as double-T carriers, T carriers, or pipe piles, for example.

It is further disclosed that a given number of sheet-pile wall sections be provided, extending in the shape of an arc or polygon, and each consisting of sheet-pile wall components that are each part of the sheet-pile wall sections being joined to an immediately adjacent sheet-pile wall section by means of a connecting profile, and each connecting profile in turn is engaged with an anchorage embedded in the soil.

In both applications described above, the connecting profiles that are used are advantageously identically constructed. In a first instance, this makes it easier to set up the arrangement. In addition, when all the connecting profiles have the same dimensions, the arrangement does not contain a weak point at the joint.

It is beneficial when the anchorage comprises a carrier element which is secured in the soil, preferably a double-T carrier, a T carrier, or a pipe pile which has been driven into solid ground by ramming or vibration. The connecting profile can then be secured directly to the carrier element which is provided with a corresponding lock bar, for instance a weld-on profile, for this purpose. Alternatively, the connecting profile is coupled or joined to the carrier element indirectly. An additional sheet-pile wall section formed from sheet-pile wall components is suitable for this, which serves as a supporting wall or retaining wall. In order to further increase the anchoring effect, Z-piles or U-piles can be used as sheet-pile wall components for the other sheet-pile wall section. The Z or U shape of the sheet piles causes the tensile forces and shearing forces impinging between the connecting profile and the anchorage to be partly reduced by the additional friction and retention forces impinging between the Z or U shaped sheet piles and the ground, thereby relieving the anchorage. This way, the overall arrangement has a higher resistance to forces impinging from the outside.

When the arrangement according to the invention is constructed as a quay wall, for example, it is proposed that the area that is partly surrounded by the sheet-pile wall sections extending in the shape of an arc or polygon be filled with soil, while the side of the sheet-pile wall sections averted from the surrounded area protrude from the soil so that the sheet-pile wall sections hold back the soil contained in the surrounded areas.

In a particularly preferred embodiment of the connecting profile for the arrangement according to the invention, the directions of contact, with which the directions of main force impact on the sheet-pile wall components which are joined with the connecting profiles and on the anchorage are aligned, lie at a 120 degree angle to one another. The working point of every lock profile, which bears the impact of the resulting tensile force with the sheet-pile wall components hooked on so as to extend in the direction of contact or with the anchorage hooked on, is the same radial distance from the superficial center of gravity of the connecting profile as the working points of the other two lock profiles. One effect of such a configuration of the connecting profile wherein the working points are the same radial distance from the connecting profile's superficial center of gravity is that the tensile forces impinging upon the connecting profile as a result of the sheet-pile wall sections, and the anchorage that is hooked on, are evenly distributed across the connecting profile so that they at least partly cancel one another out. Secondly, the installation position of the connecting profile is immaterial. The connecting profile can be rammed into the ground with one face side as well as the other. Furthermore, it is also immaterial which lock profile of the connecting profile the respective sheet-pile wall components or anchorage engages with. In the past it has been demonstrated that the use of asymmetrical connecting profiles to join three sheet-pile wall sections always causes problems. Frequently the connecting profiles are rammed into the ground on construction sites without checking if they are in the proper position. But when asymmetrical connecting profiles are in the wrong position, the course of the sheet-pile wall sections relative to each other does not correspond to the optimal flow of forces, so in the worst case there is a danger that the forces impinging upon the sheet-pile wall sections will be insufficiently diverted to the anchorage.

In order to achieve the greatest possible flexibility in the construction of the arrangement according to the invention, it is proposed that a connecting profile be used wherein the lock profiles are designed so that the lock of the sheet-pile wall components and the anchorage in which the lock profile of the connecting profile is hooked are slewable at least 15 degrees in the lock profile.

The effect of such a connecting profile construction is that the sheet-pile wall components and the anchorage move relatively freely when in the inner lock chambers of the lock profiles of the connecting profile, which all but completely rules out the possibility of the locks tilting in the lock profiles of the connecting profile when the piles are driven into the ground. In addition, imprecision in the course of the sheet-pile wall sections and the anchorage which are joined to the connecting profile can be compensated for.

It is particularly beneficial to use a connecting profile for the arrangement according to the invention wherein each lock profile comprises a thumb bar with a middle ridge, at which a thumb is formed which extends transverse to its longitudinal direction and protrudes beyond the middle ridge, along with a curved finger bar, the free end of which points in the direction of the thumb bar, forming an inner lock chamber with an at least approximately elliptical or oval cross section and, together with the end of the thumb pointing in the direction of the finger bar, defining a mouth for the lock of the sheet-pile wall section being hooked on and to the lock of the anchorage. The lock of the sheet-pile wall section is hooked on and the lock of the anchorage consists of a curved finger bar and a thumb bar which have corresponding dimensions.

When the lock profiles of the connecting profiles and the locks of the sheet-pile wall components and the anchorage are designed in a complementary fashion accordingly, the cross-section of the engaged lock profiles and locks corresponds to the described three-point connection. Now the thumb of the lock of the sheet-pile wall components or the anchorage is received in the locking chamber of the lock profile of the connecting profile, whereas the thumb of the connecting profile is received in the locking chamber of the lock of the sheet-pile wall components or the lock of the anchorage. When tensile force impinges upon the sheet-pile wall, components or the anchorage in the direction of contact, the two thumbs brace against each other and the finger bars of the other lock, respectively, such that the two locks, when viewed in cross-section, abut at three points respectively, which is to say they mutually support each other.

This three-point connection is capable of resisting extremely high tensile forces which may amount to several tens of thousands of kilonewtons due to the fact that the interaction of the thumb bars and finger bars of the locks engaging one another makes it all but impossible for the finger bars to bend or the thumb bars to break off under normal tensile forces. At the same time, the lock configuration guarantees that the engaged locks can pivot relative to one another at least to a limited degree without becoming loose. That simplifies the construction of the arrangement in a first instance. It is also makes it easier to configure the sheet-pile wall components in a circle relative to one another in the area of the connecting profile as required in order to construct the open cell structure.

It is further proposed in a particularly preferred embodiment of the connecting profile described above which is used for the arrangement according to the invention that at least one of the lock profiles be designed in such a way that it extends at an angle relative to its given direction of contact, when viewed in cross-section, such that the direction of main force impact on the lock of the sheet-pile wall components which is hooked into the lock profile pivots at least 8 to 12 degrees in either direction about the given direction of contact.

It has been shown that with a lock profile formed from a thumb bar and finger bar, if it is aligned precisely at the base relative to the given direction of contact, the pivoting of the sheet-pile wall components out of the given direction of contact is limited in the direction of the thumb bar, while the sheet-pile wall components' pivoting motion out of the given direction of contact in the opposite direction is possible many times over. Designing the lock profile at the base so that it is at an angle to the given direction of contact gives the sheet-pile wall components the ability to be pivoted in both possible directions by at least approximately the same maximum angles relative to the given direction of contact with their lock in the lock profile of the connecting profile according to the invention.

It is also beneficial when the lock profile in the connecting profile used for the arrangement extends with the main axis of its inner lock chamber, which has an elliptical or oval cross-section, at an angle of 5 to 10 degrees relative to its given direction of contact, with its thumb bar angled away from the given direction of contact. As long as the lock profile extends at such an angle relative to the base, the sheet-pile wall components can pivot in other directions relative to the given direction of contact by approximately the same angle. It is particularly beneficial when the lock profile comprises an angle of 7 to 8 degrees.

It is further provided that, in order for all the sheet-pile wall components to be able to pivot relative to the given directions of contact in opposite directions by at least approximately the same angle, all lock profiles should extend at an angle of 5 to 10 degrees relative to the directions of contact, with the two lock profiles whose thumb bars are formed at the base immediately adjacent one another being angled toward one another.

But if installation position is not a problem, it is also possible to use a connecting profile wherein the lock profiles whose thumb bars are formed at the base immediately adjacent one another are farther from the superficial center of gravity of the connecting profile than the other of the three lock profiles. This allows the arrangement's sheet-pile wall components which are hooked into the lock profiles with immediately adjacent thumb bars to have enough room to pivot so that they do not collide with the connecting profile's base.

In a particularly preferred development of the connecting profile, the ratio between the opening width of the mouth of each lock profile and the maximum opening width of the inner lock chamber of the respective lock profile is between 1 to 2 and 1 to 2.5 so that the locks of the sheet-pile wall components have enough room to pivot inside the connecting profile's lock profiles. Here, it is also beneficial when the ratio of the length of the thumb bar, as viewed transverse to the longitudinal direction of the middle ridge, and the maximum opening width of the inner lock chamber is between 1 to 1.2 and 1 to 1.4 in every lock profile of the connecting profile. When the thumb is appropriately constructed, the lock of the sheet-pile wall components and the lock of the anchorage are guaranteed to be able to pivot in the inner locking chamber, and at the same time the lock is guaranteed to sufficiently hook into the lock profile which prevents the locks engaged with one another from inadvertently becoming loose.

In order to improve the ability of the sheet-pile wall components to pivot, in a development of the connecting profile, it is further provided that the middle ridge of the thumb bar be constructed so that the ratio between the thickness of the middle ridge, observed transverse to its longitudinal direction, and the opening width of the mouth is between 1 to 1.2 and 1 to 1.4.

The three design features described above, namely the ratio between the opening width of the mouth and the opening width of the locking chamber, the ratio between the length of the thumb and the opening width of the inner lock chamber, and the ratio between the thickness of the middle ridge and the opening width of the mouth, can each be realized jointly, separately, or partially in at least one of the lock profiles.

In order to ensure that the forces impinging upon the lock profiles, which are frequently on the order of several thousand kilonewtons, do not damage the lock profile, it is further proposed that in each lock profile of the connecting profile used, the ratio between the thickness of the middle ridge, observed transverse to the longitudinal direction thereof, and the length of the thumb, observed transverse to the middle ridge's longitudinal direction, is between at least 1 to 2.3 and 1 to 2.5. The length of the thumb is a particularly important determinant of the ability of the lock of the sheet-pile wall components to pivot because the lock is pivoted about the thumb of the thumb bar, and the lock is supposed to engage with the thumb of the thumb bar in particular, partly surrounding it, thereby guaranteeing a secure hold in the inner lock chamber. The result of this is that the thickness of the middle ridge at which the thumb is formed is only allowed to be dimensioned such that the lock is able to be pivoted without impediment in the inner lock chamber, on one hand, and so that, on the other hand, the thumb bar is prevented from becoming deformed or breaking off.

In order to give the connecting profile that is used sufficient stability, it is further provided that the wall thickness of the curved finger bar of each lock profile in the area of the maximum opening width of the inner lock chamber be larger by a factor of 1.1 to 1.3 than the thickness of the middle ridge, observed transverse to its longitudinal direction, in the area of the maximum opening width of the inner lock chamber.

In a particularly preferred embodiment of the connecting profile, the three directions of contact of the three lock profiles run at a 120° offset relative to one another so that sheet-pile wall sections can be connected which approach the connecting profile at a mutual offset of 120 degrees. The present invention also contemplates designing the connecting profile in such a way that, for example, two of the lock profiles stick out of the base in opposite directions of contact, in other words at a 180 degree offset, while the third lock profile runs at a 90 degree angle relative to the other two.

The base body of the utilized connecting profile can be designed in the shape of a cylinder from which the lock profiles stick out radially in the different directions of contact. But in the alternative it is also possible to design the base in the shape of a star; i.e., with ridges sticking out in the three directions of contact in the shape of a star, at the ends of which the lock profiles are formed. A connecting profile with this configuration is particularly well suited to bridging large distances between individual sheet-pile wall components that have to be joined.

BRIEF DESCRIPTION OF THE DRAWINGS

The invention will now be described in detail with the aid of an exemplifying embodiment and modifications thereof, and with reference to the accompanying drawing in which.

DETAILED DESCRIPTION

Figure 1:
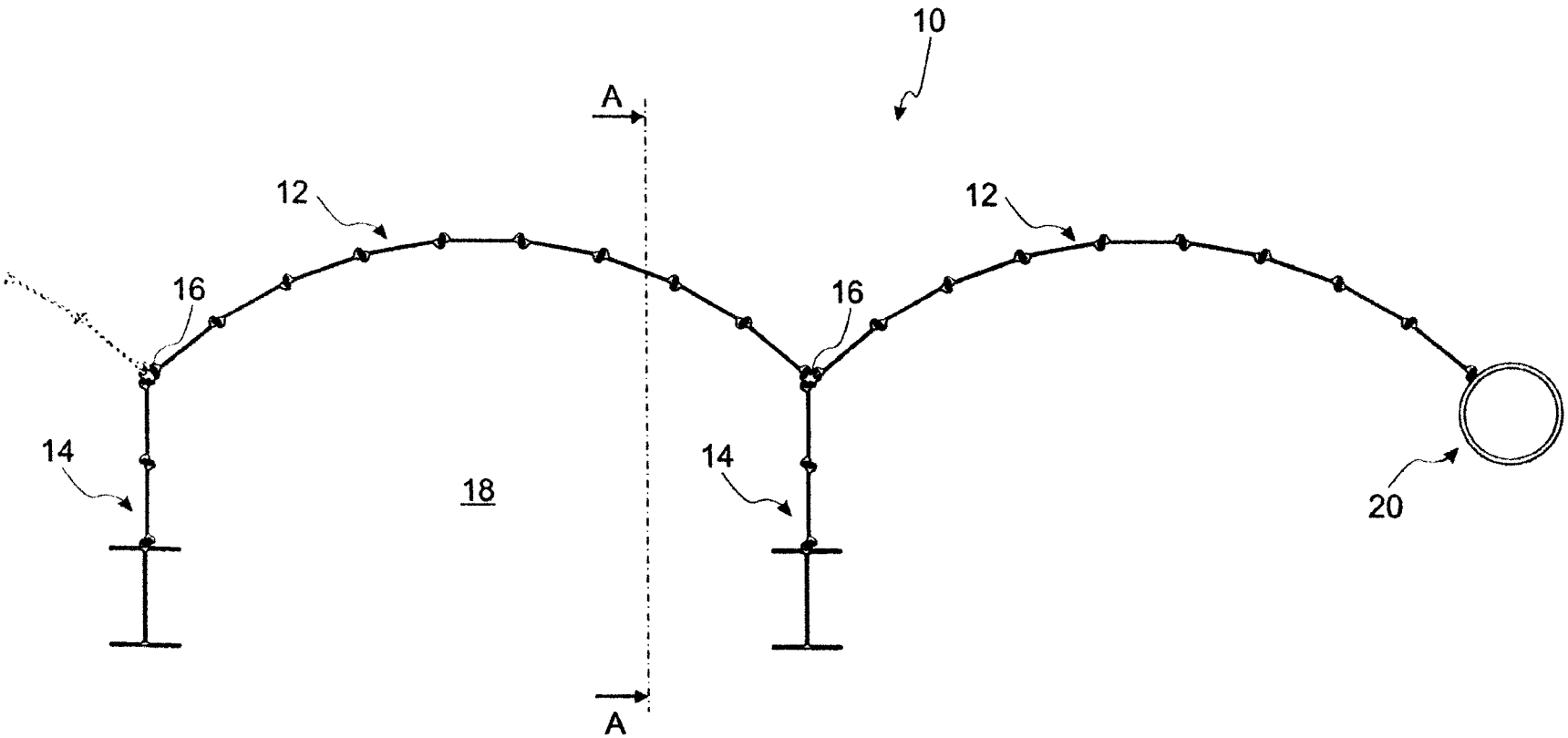
FIG. 1 is a plan view of an arrangement according to the invention with multiple open cells whose ends are secured in the ground by pipe piles.

FIG. 1 is a plan view of a section of an arrangement 10 configured according to the invention. The arrangement 10 is formed from multiple arc-shaped sheet-pile wall sections 12 which are joined by means of connecting profiles 16 to first anchorages 14 which are secured in the ground. Each arc-shaped sheet-pile wall section 12 forms a so-called open cell 18 with two first anchorages 14. The end of the sheet-pile section 12 represented in FIG. 1 is connected to a pipe pile 20 that has been driven into the ground, which serves as a closing element for the arrangement 10, as will be explained further below.

Figure 2:
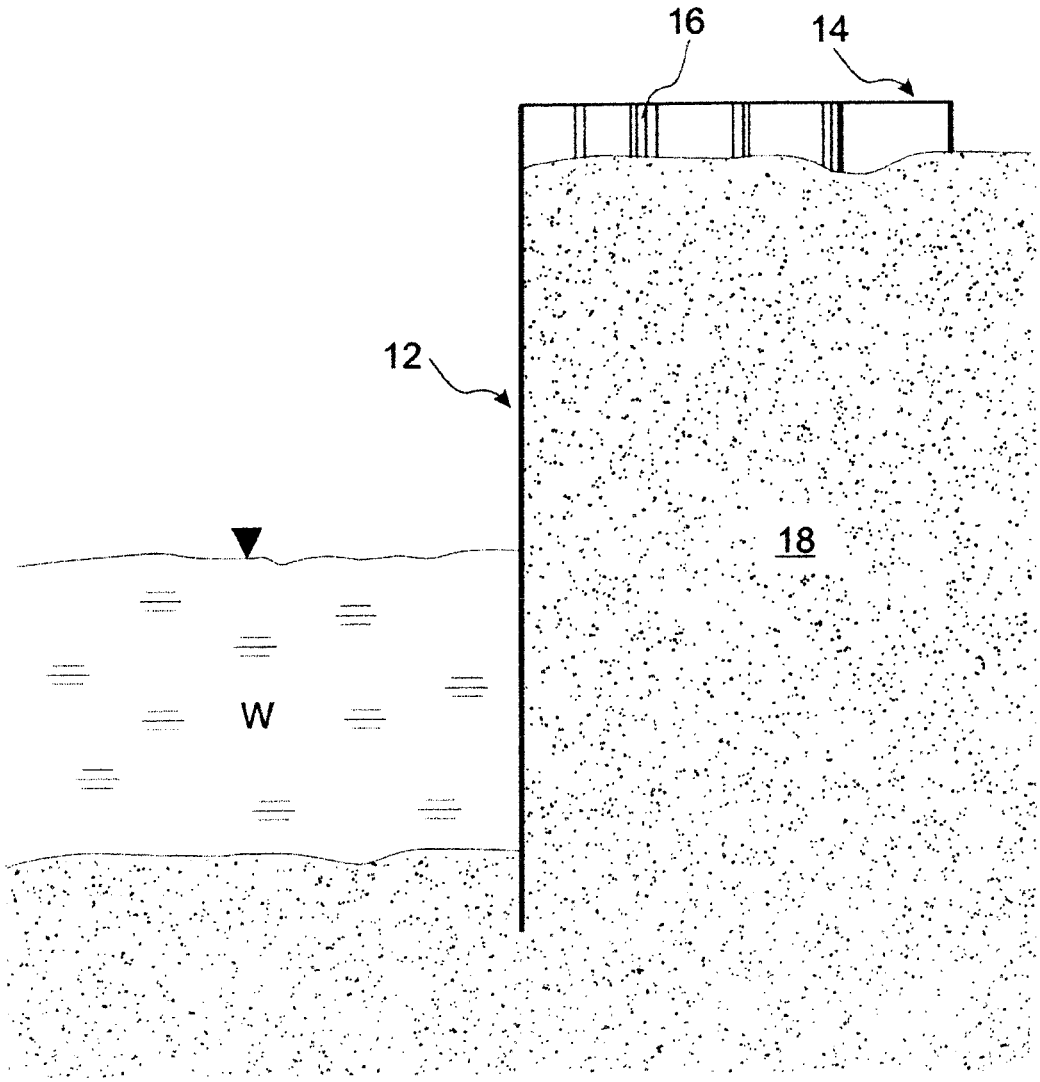
FIG. 2 is a sectional view along the line A-A in FIG. 1 showing the construction of one of the open cells in a side view.

FIG. 2 is a view representing a section taken along line A-A in FIG. 1. As the view shows, the open cell 18 which is partly surrounded by the arc-shaped sheet-pile wall section 12 is filled with soil, whereas the area outside the open cell 18 (left-hand side of FIG. 2) is a shoreline area which is secured by means of the arrangement 10 in this example. The sheet-pile wall sections 12 have only been partly driven into the ground, so the water pressure of the impinging water (W) on one side and the ground pressure inside the open cell 18 on the other support the sheet-pile wall sections 12 laterally, while in the downward direction the sheet-pile wall section 12 is only partially driven into the ground. In order to prevent the sheet-pile wall sections 12 from coming out of the ground, they are secured in solid ground by the anchorage 14 and 20.

Figure 3:
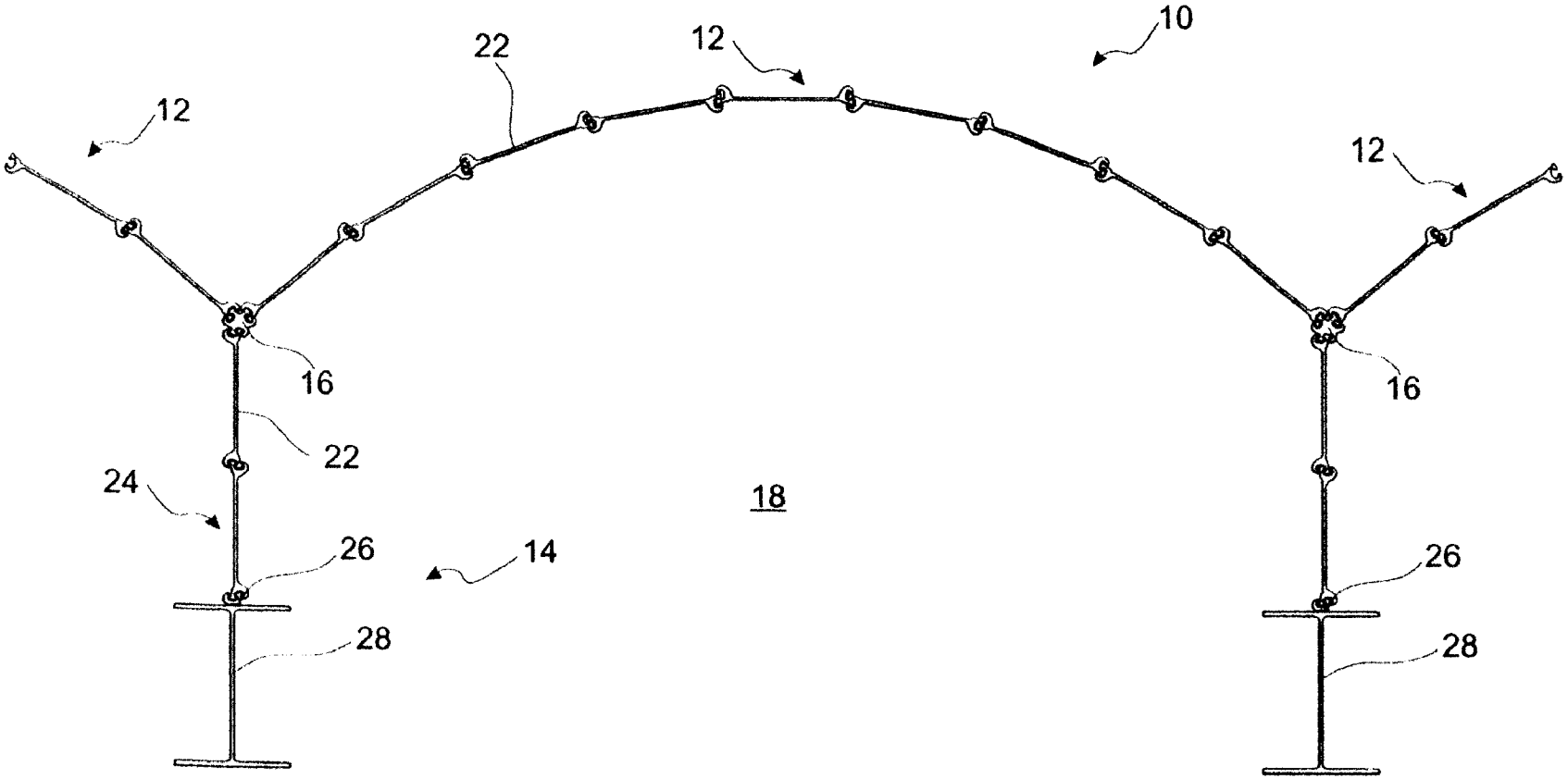
FIG. 3 is a first enlarged section of the arrangement according to FIG. 1 showing three sheet-pile wall sections and two anchorages, with two sheet-pile wall sections joined to one anchorage in each case by means of a connecting profile.

FIG. 3 is an enlarged plan view representing a section of the arrangement 10 for purposes of laying out the construction of the arrangement 10 in greater detail. The sheet-pile wall section 12 represented in FIG. 3 consists of a total of nine sheet piles 22, in this case union flat profiles, which are driven into the ground in an arc configuration and hooked into each other. The last two sheet piles 22 of the sheet-pile wall section 12, disposed at either end, are hooked into the lock profiles of two connecting profiles 16 whose construction will be described in detail further below. As FIG. 1 shows, additional arc-shaped sheet-pile wall sections 12 are hooked into the other lock profiles of the two connecting profiles 16 accordingly.

The third lock profile of each connecting profile 16 is engaged with a supporting wall 24 which is formed from sheet piles 22, in this case as well union flat piles. The supporting wall 24 is joined, by means of a weld-on profile 26, with a double-T carrier 28 which has been rammed into the ground. The supporting wall 26 and the double-T carrier 28 joined therewith form the first anchorage 14.

As made abundantly clear by the arrangement represented in FIG. 1, deviations in the course of sheet-pile wall sections 12 can be compensated by means of the connecting profile 16, which is especially important where multiple sheet-pile wall sections have to be joined at a common point.

Figure 4:
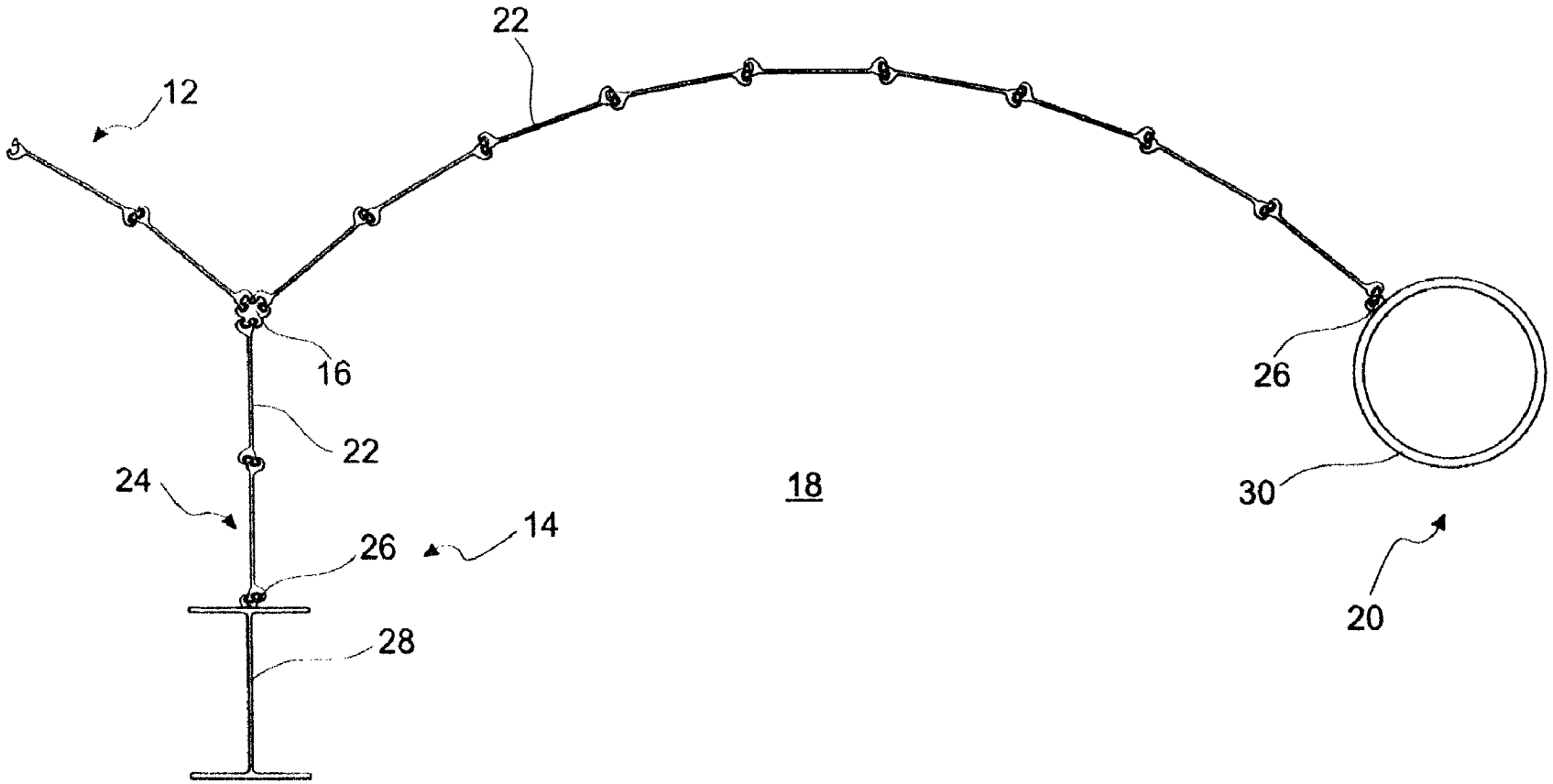
FIG. 4 is a second enlarged section of the arrangement according to FIG. 1 showing one full sheet-pile wall section and another, partial sheet-pile wall section, with the full sheet-pile wall section being joined to one anchorage at one end by means of a connecting profile and being joined to a pipe pile at its other end.

FIG. 4 represents another section of the arrangement 10 in an enlarged plan view. This section represents the securing of the end of the sheet-pile wall section 12, for instance in solid ground on the shoreline. Stabilization is facilitated by means of the second anchoring 20, which in this example consists of a pipe pile 30 that has been driven into the ground. The last sheet piles 22 of the sheet-pile wall section 12 are stabilized by means of a weld-on profile 26 which is welded onto the shell of the pipe pile 30.

Figure 5:
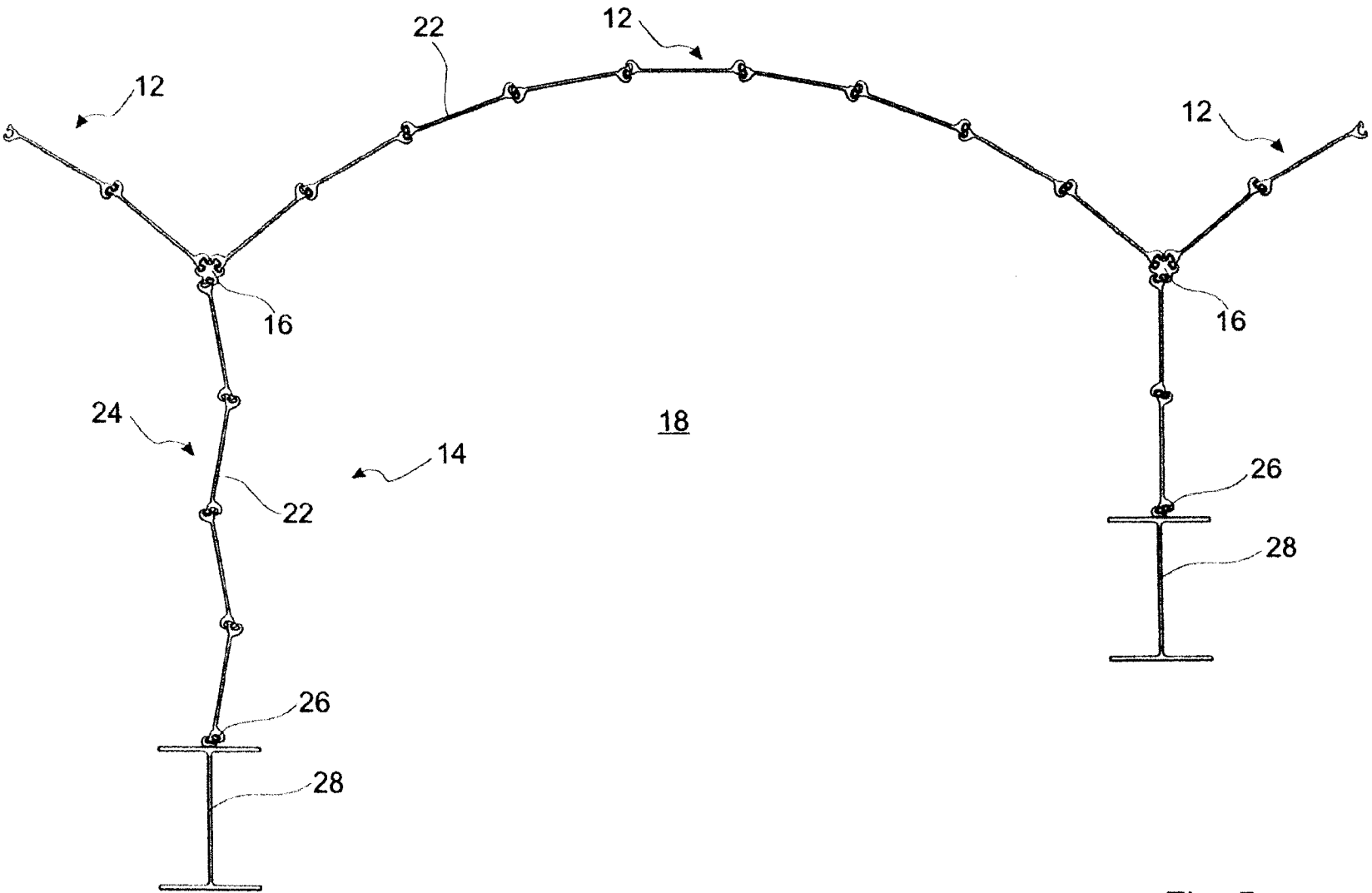
FIG. 5 is a section corresponding to the section shown in FIG. 3 but with a modified anchorage of the open cell structure.

Lastly, FIG. 5 represents one possible modification of the first anchorage 14 represented in FIG. 3. In order to relieve the double-T carrier 28 of extremely high tensile and shearing forces, which could be transferred from the sheet-pile wall sections 12 to the double-T carrier 28 by means of the supporting wall 24, and in order to increase the resistance of the overall anchorage 14 to any tensile forces and shearing forces that might occur, the supporting wall 24 is made of a total of four sheet piles 22 instead of two. Furthermore, the four sheet piles 22 have been driven into the ground at an angle of 10 degrees out of alignment in an alternating fashion, from a cross-sectional perspective, in order to be able to counteract the tensile and shearing forces impinging in alignment upon the supporting wall 24 by means of greater frictional and holding forces. It would also be possible to use U shaped or Z shaped sheet piles driven into the ground for the supporting wall 24 instead of the angled configuration of the sheet piles 22.

Figure 6:
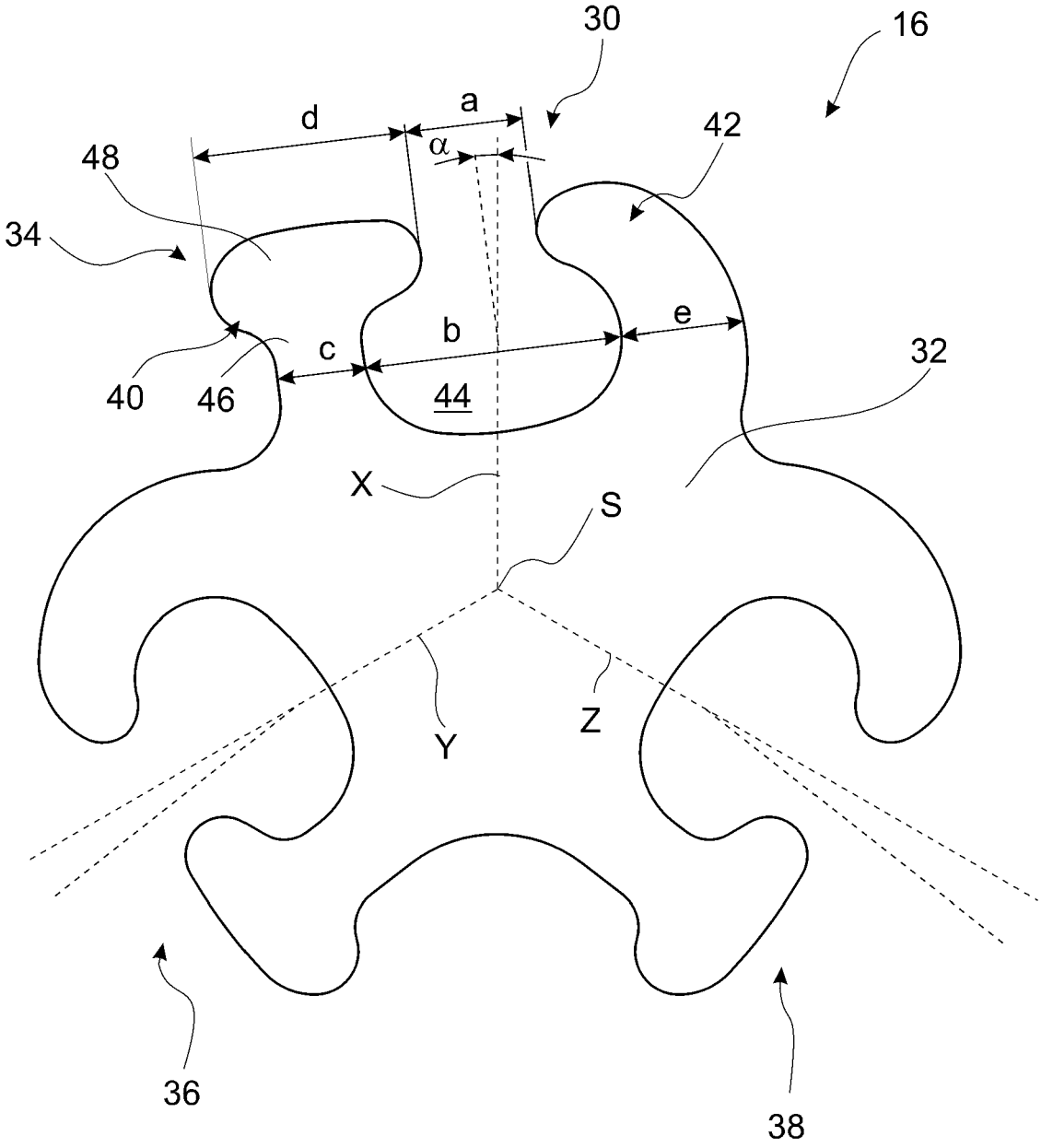
FIG. 6 is a plan view of the face side of an exemplifying embodiment of a connecting profile used in the arrangement according to FIG. 1 with three lock profiles which are offset 180 degrees to one another.
Figure 7:
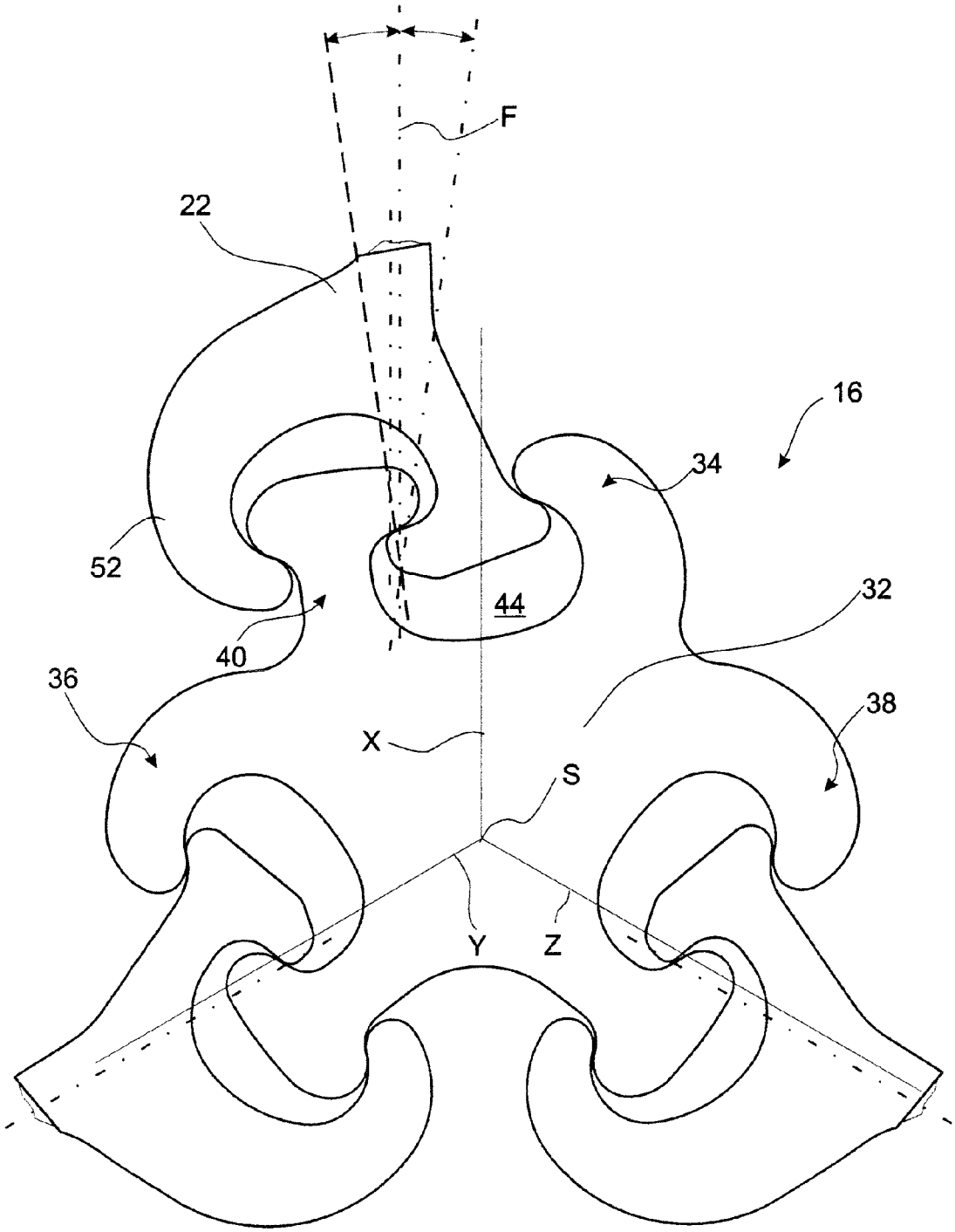
FIG. 7 is a plan view of the connecting profile according to FIG. 6 in which a total of three flat profiles are hooked in as sheet-pile wall components.

FIGS. 6 and 7 represent a plan view of an exemplifying embodiment of a connecting profile 16 which is used in the arrangement 10, which has a constant cross-section over its entire length. The connecting profile 16 serves for joining two sheet-pile wall sections 12 with the supporting wall 24. The connecting profile 16 represented in FIGS. 6 and 7 has three prescribed directions of contact X, Y and Z, which are at a 120 degrees offset relative to one another. Direction of contact X, Y or Z in this sense means the direction in which the sheet piles 22 form a so-called three-point connection with the connecting profile 16 in cross-section when the piles are hooked on.

The connecting profile 16 has a base 32 from which three lock profiles 34, 36 and 38 project in directions of contact X, Y and Z. Since lock profiles 34, 36 and 38 are identical, the construction of lock profiles 34, 36 and 38 will be described below with reference to FIG. 6 with the aid of lock profile 34 as represented in FIG. 6 above.

The lock profile 34 has a thumb bar 40 which projects from the base 32 and, spaced therefrom, a finger bar 42, the two of which protrude from base 32 together and partly surround an inner lock chamber 44.

The thumb bar 40 is formed by a middle ridge 46 which emerges from the base 32, at the free end of which a thumb 48 is formed, extending transverse to the longitudinal direction of the ridge, which extends beyond the ridge 46 in both directions.

The finger bar 42 also emerges from the base 32 and extends toward the thumb bar 40 in a curved manner. The finger bar 42 ends together with the exterior surface of the thumb 48 in a tangential plane (not represented) and defines a mouth 50 together with the end of the thumb 48 that points in the direction of the finger bar 42.

The transitions between the base 32 and the middle ridge 46, between the middle ridge 42 and the thumb 48, and between the base 32 and the finger bar 42 are rounded and their shape conforms to that of an ellipse so that the inner lock chamber 44 has an inner cross-section that is at least approximately elliptical.

In the connecting profile 16 the sheet piles 22 that will be hooked on can be pivoted in a defined fashion with their locks 52 in the inner lock chambers 44 of the lock profiles 34, 36, and 38 during which time a secure hold of the lock 52 of the sheet pile 22 in the chamber 44 of the connecting profile 16 is still guaranteed in every pivot position of the sheet pile 22.

In order to simplify pivoting, the following design features are additionally provided for the connecting profile 16 according to the invention. First the ratio between the opening width (a) of the mouth 50 and the maximum opening width (b) of the inner lock chamber 44 is approximately 1 to 2.1. The ratio between the thickness (c) of the middle ridge 46, as viewed transverse to its longitudinal direction, and the opening width (a) of the mouth 50 is 1 to 1.3 in turn. The ratio between the thickness (c) of the middle ridge 46, as viewed transverse to the longitudinal direction thereof, and the length (d) of the thumb 48, as viewed transverse to the longitudinal direction of the middle ridge 46, is 1 to 2.3. Furthermore, the ratio of the length (d) of the thumb 48, as viewed transverse to the middle ridge 46, and the maximum opening width (b) of the inner lock chamber 44 is 1 to 1.25.

This design feature guarantees that the lock 52 of the sheet pile 22 retains its ability to pivot some 16 degrees without the lock 52 of the sheet pile 22 jumping out of the locking profile 34, 36 or 38 of the connecting profile 16.

But in order to guarantee that the locking profile 34, 36 and 38 is able to resist the arising holding forces and does not break despite the potential ability of the sheet-pile wall components to pivot, the bars 40 and 42 which form the locking profile 34, 36 and 38 are dimensioned accordingly.

The wall thickness (e) of the curved finger bar 42 of each locking profile 34, 36 and 38 in the area of the maximum opening width b of the inner lock chamber 44 is larger by a factor of 1.2 than the thickness (c) of the middle ridge 46 as viewed transverse to its longitudinal direction in the area of the maximum opening width (b) of the inner lock chamber 44. Since the tensile force portion impinging on the thumb bar 40 along the longitudinal direction of the middle ridge 46 is greater than the transverse force portion, the middle ridge 46 of the thumb bar 40 can be constructed weaker than the finger bar 42. In contrast, at the finger bar 42 the impinging transverse force is greater, so a relatively large bending momentum impinges upon the finger bar, which the finger bar must absorb.

In order to ensure that the sheet piles 22 to be hooked on can pivot at least approximately over the same angle range relative to the directions of contact X, Y and Z respectively, the three locking profiles 34, 36 and 38 are constructed on the base 32 such that they tilt relative to the directions of contact X, Y and Z, as explained below.

The locking profile 34 represented at the top of FIG. 6 is at an angle $\alpha$, in this case a 7.5 degree angle, relative to direction of contact X, in which case the thumb bar 42 is angled away from direction of contact X.

The two other locking profiles 36 and 38 are also fashioned on the base 32 at a 7.5 degree angle to directions of contact Y and Z respectively, with the thumb bars 32 being angled away from the directions of contact Y and Z again here.

Since the two locking profiles 36 and 38 represented at the bottom of FIG. 6 are disposed closer to each other by virtue of being angled, in turn the distance from the two locking profiles 36 and 38 to the superficial center of gravity (S) of the connecting profile 16 is greater than the distance between the top locking profile 34 and the same point. This ensures that the sheet piles 22 that will be hooked into the two locking profiles 36 and 38 do not touch even when moved as close together as possible.

FIG. 7 represents the connecting profile 16 according to the invention with the union flat profiles represented in FIGS. 1 to 5 as sheet piles 22 hooked onto thumb bars 40 on its lock profiles 34, 36 and 38. The pivoting range within which the sheet pile 22 can be hooked on the connecting profile 16 is represented in FIG. 7 for the lock profile 34 represented at the top of the figure. In this example, the sheet pile 22 can be hooked on the connecting profile 16 in a pivoted position, said pivot comprising an angle of some 8.5 degrees between a first end position and a second end position, proceeding from a starting position in which the direction of main force impact F on the sheet pile 22 is parallel to the direction of contact X, so the pivot range is approximately 8.5 degrees as indicated by the two arrows, and the engaged locks 34 and 52 make contact at three points from a cross-sectional perspective.

Figure 8:
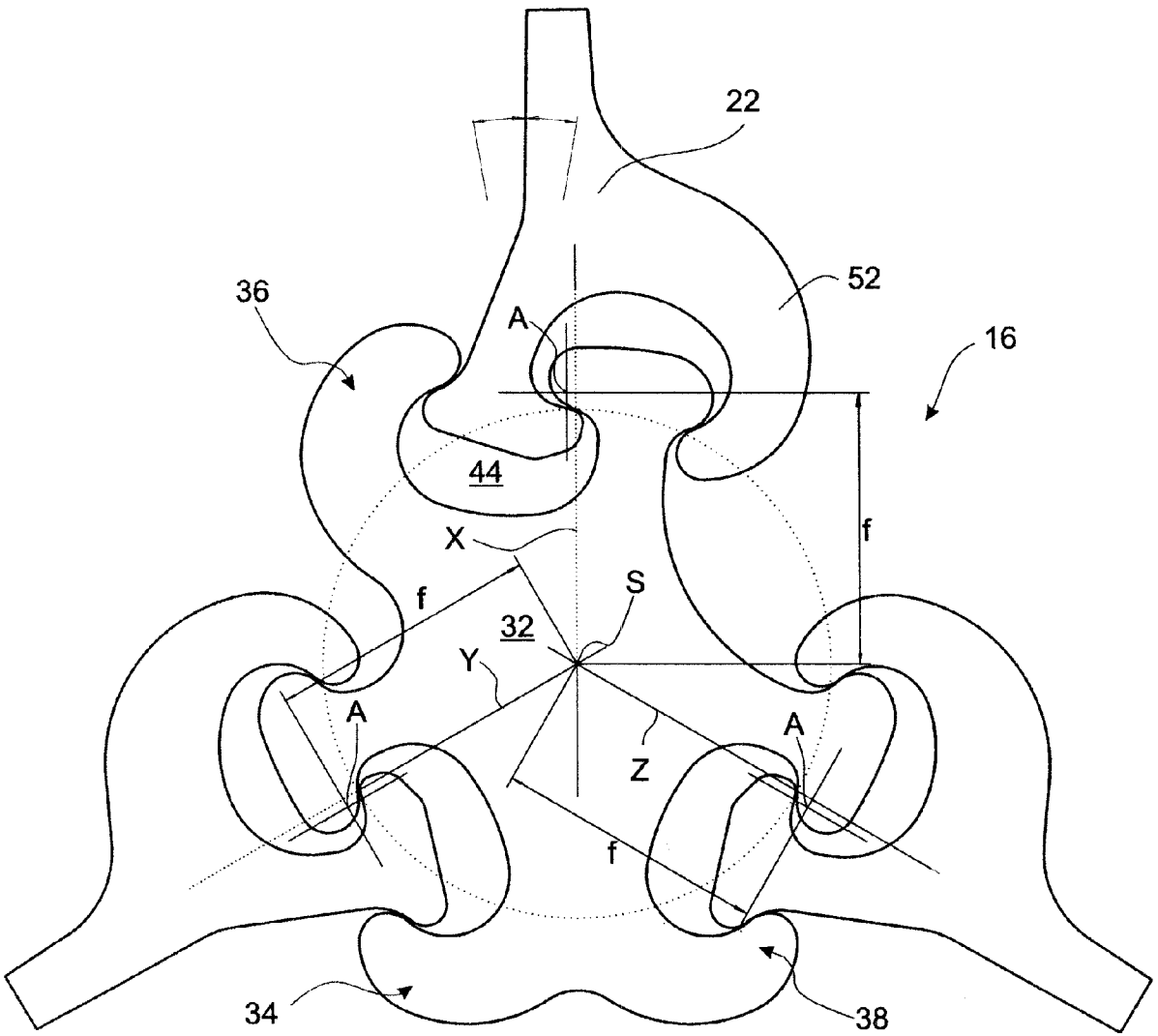
FIG. 8 is a plan view of the face side of a first modification of the exemplifying embodiment shown in FIGS. 6 and 7 wherein the working points of the lock profiles are the same radial distance from the superficial center of gravity.

FIG. 8 shows a first modification of the connecting profile 16 represented in FIGS. 6 and 7. In this modified connecting profile 16*a* the lock profiles 34*a*, 36*a* and 38*a* are also fashioned on the base 32*a* at a 120° offset from each other. A unique aspect of this connecting profile 10*a* is that the working point A of each lock profile 34*a*, 36*a* and 38*a* upon which the resulting tensile force impinges if the sheet pile 22 has been hooked on so as to extend in direction of contact X, Y or Z is the same radial distance (f) from the superficial center of gravity (S) of the connecting profile 16*a* as the working points A of the two other lock profiles 36*a*, 38*a* and 34*a* respectively. This configuration of the connecting profile 16*a* whereby the working points (A) are the same radial distance from the superficial center of gravity (S) of the connecting profile 16*a* causes the tensile forces impinging upon the connecting profile 16*a* as a result of the hooked-on sheet piles 22 to be evenly distributed across the connecting profile 16*a* and to at least partly cancel each other out. Another consequence is that the installation position of the connecting profile 16*a* is variable, so one can integrate the connecting profile 16*a* in any position without having to pay any attention to the course of the lock profiles 34*a*, 36*a* and 38*a* when hooking on the sheet piles 22.

FIGS. 9 to 15 represent additional modifications of the connecting profile 16 wherein the base 32 consists of ridge bars in, for instance, a star configuration, at the free ends of which the lock profiles 34, 36 and 38 are fashioned. However, it should be noted that in all the modifications shown the design features with respect to the opening width of the mouth 50, the opening width (b) of the inner lock chamber 44, the thickness (c) of the middle ridge 46, the length (d) of the thumb 48, and the wall thickness (e) of the finger bar 42 are realized in an analogous manner. In the modifications represented in the figure, the lock profiles 34, 36 and 38 are not at an angle to directions of contact X, Y and Z but configured such that the inner lock chamber 44 at its maximum opening width (b) extends approximately at a right angle to the direction of contact X, Y and Z.

It bears noting, however, that in these modifications too it is possible for at least one of the lock profiles 34, 36 and 38 to extend at an angle relative to the directions of contact X, Y and Z as described above with reference to FIGS. 6 and 7.

Figure 9:
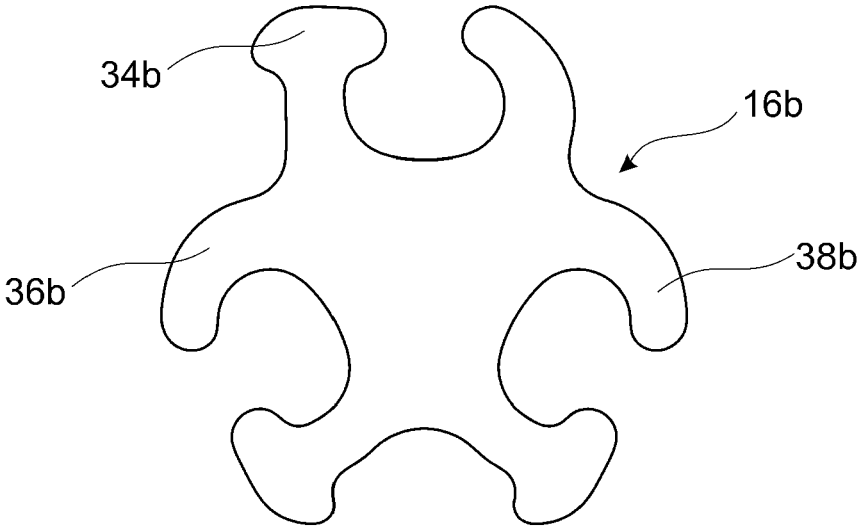
FIG. 9 is a plan view of a second modification of the exemplifying embodiment represented in FIGS. 6 and 7 wherein the lock profiles are not angled relative to the directions of contact.

FIG. 9 represents a second modification 16*b* of the connecting profile 16 utilized for the arrangement 10 according to the invention, wherein the lock profiles 34*b*, 36*b* and 38*b* do not extend at an angle to the directions of contact X, Y and Z.

Figure 10:
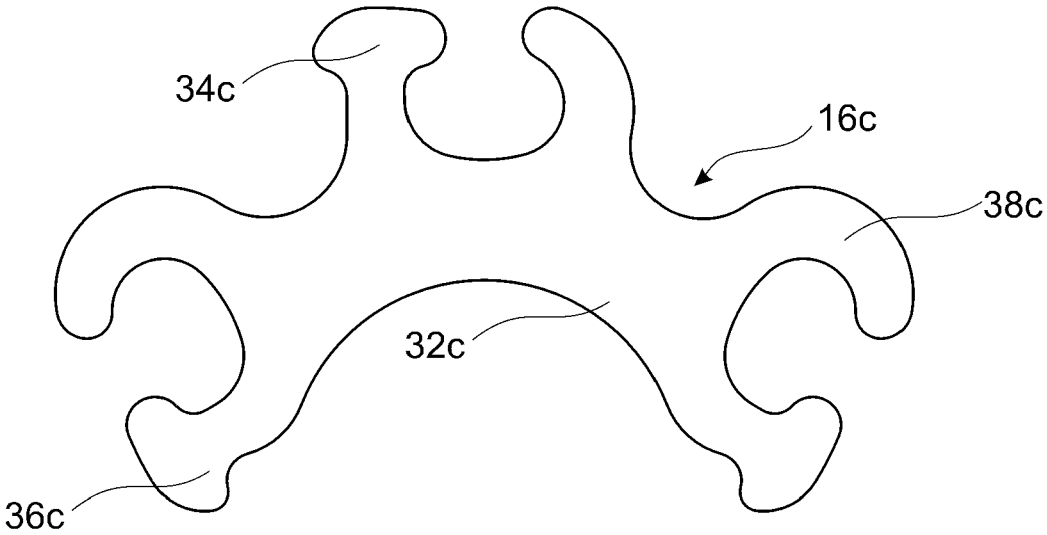
FIG. 10 is a plan view of a third modification of the exemplifying embodiment represented in FIGS. 6 and 7 wherein the base is curved and the two lock profiles whose thumb bars face each other are formed at the ends of the curved base.

In contrast, FIG. 10 represents a third modification 16*c* of the connecting profile 16 utilized for the arrangement 10 according to the invention, wherein the base 32*c* extends in a curved manner, and the two lock profiles 36*c* and 38*c* are fashioned at the ends of the curved base 32*c*. The third lock profile 34*c*, on the other hand, is fashioned in the center of the curved base 32*c*.

Figure 11:
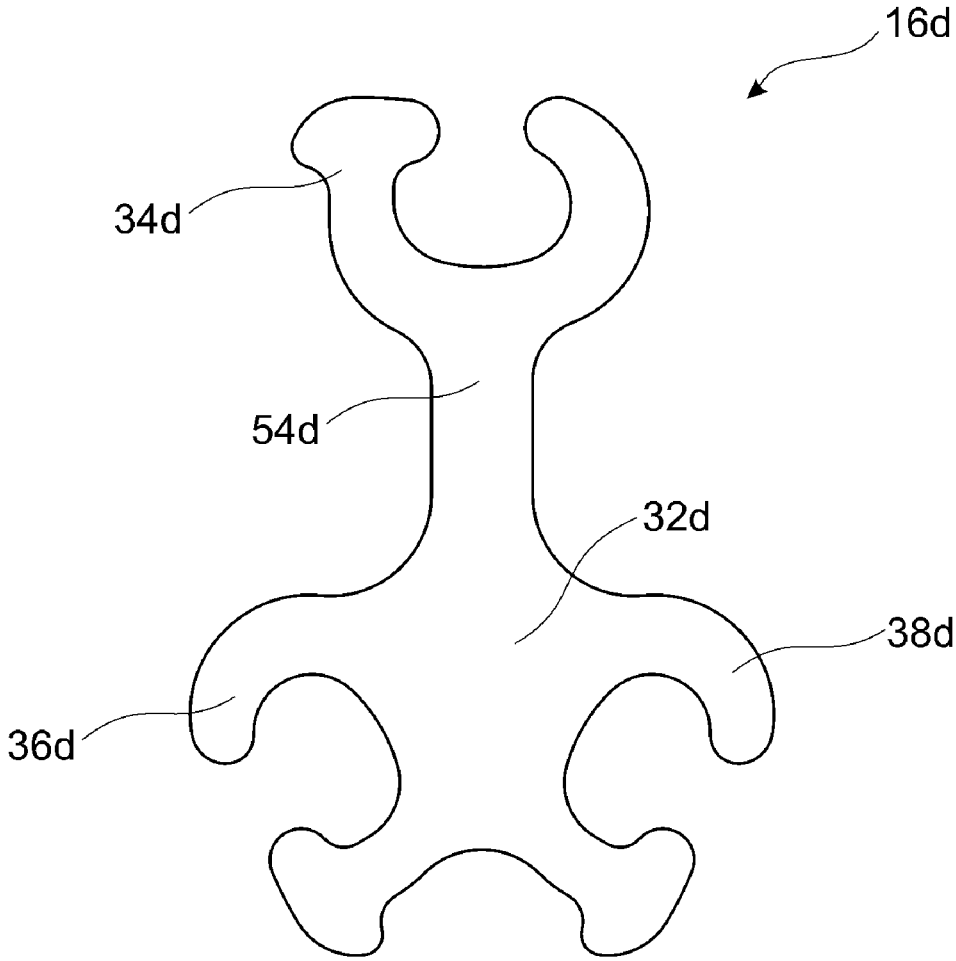
FIG. 11 is a plan view of a fourth modification of the exemplifying embodiment represented in FIGS. 6 and 7 wherein a ridge bar is fashioned on the base at the ends of which one of the lock profiles is formed.

FIG. 11 is a plan view representing a fourth modification 16*d* of the connecting profile 16 utilized for the arrangement 10 according to the invention, wherein a ridge bar 54*d* is fashioned at the base 32*d* at the ends of which one of the lock profiles 34*d* is formed.

Figure 12:
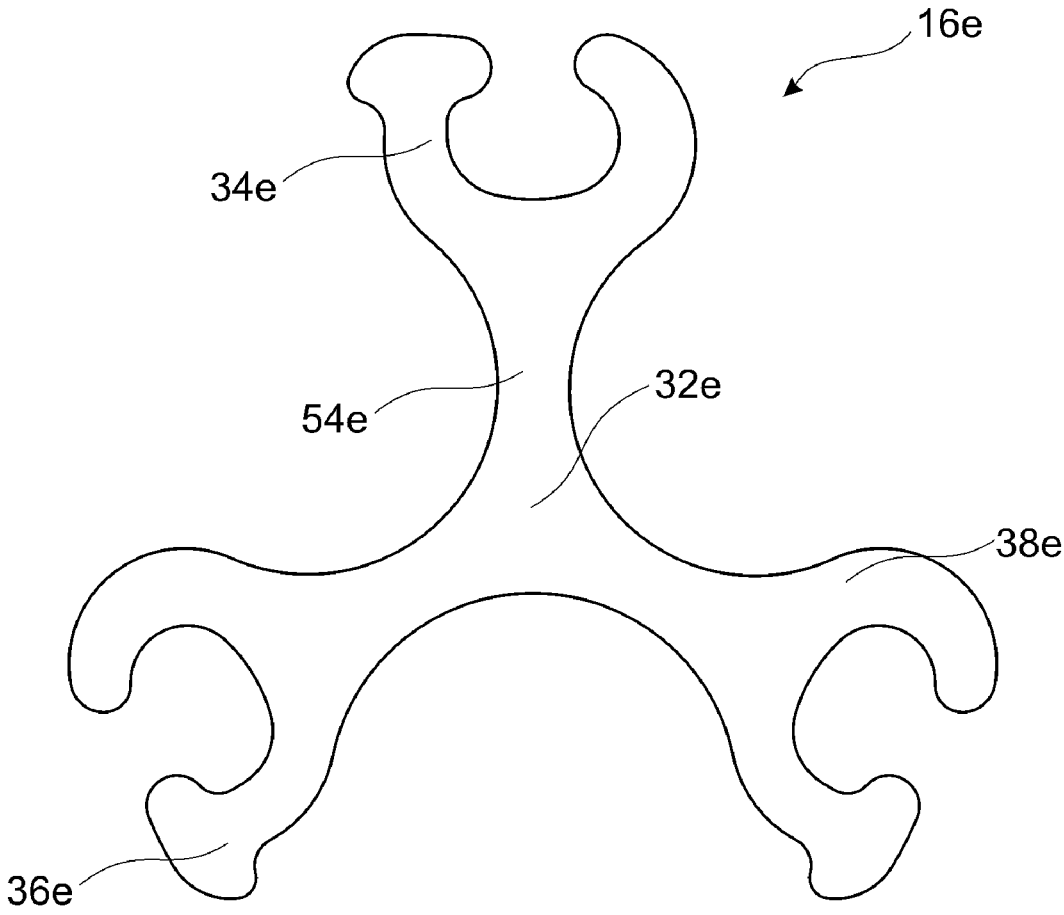
FIG. 12 is a plan view of a fifth modification of the exemplifying embodiment represented in FIGS. 6 and 7 wherein the base comprises three rounded star-shaped ridge bars at the ends of which the lock profiles are formed.

FIG. 12 is a plan view representing a fifth modification 16*e* of the connecting profile 16 utilized for the arrangement 10 according to the invention, wherein the base 32*e* comprises three rounded ridge bars 54*e* extending in a star configuration at the ends of which the lock profiles 34*e*, 36*e* and 38*e* are fashioned. The purpose of the rounded course of the ridge bars 54*e* is to better dissipate the stresses impinging upon the lock profiles 34*e*, 36*e* and 38*e*.

Figure 13:
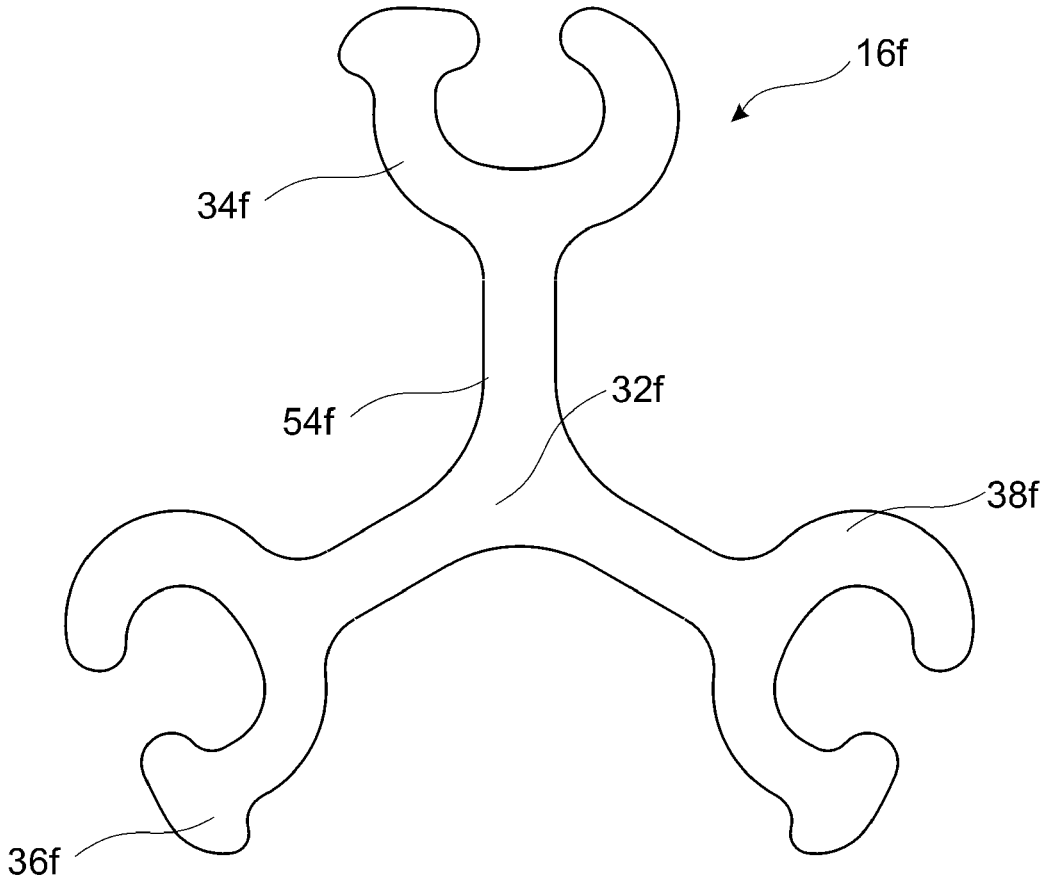
FIG. 13 is a plan view of a sixth modification of the exemplifying embodiment represented in FIGS. 6 and 7 wherein the base comprises three straight star-shaped ridge bars at the ends of which the lock profiles are formed.

FIG. 13 is a plan view representing a sixth modification 16*f* of the connecting profile 16 utilized for the arrangement 10 according to the invention, wherein the base 32*f* comprises three straight ridge bars 54*f* extending in a star configuration at the ends of which the lock profiles 34*f*, 36*f* and 38*f* are fashioned.

Figure 14:
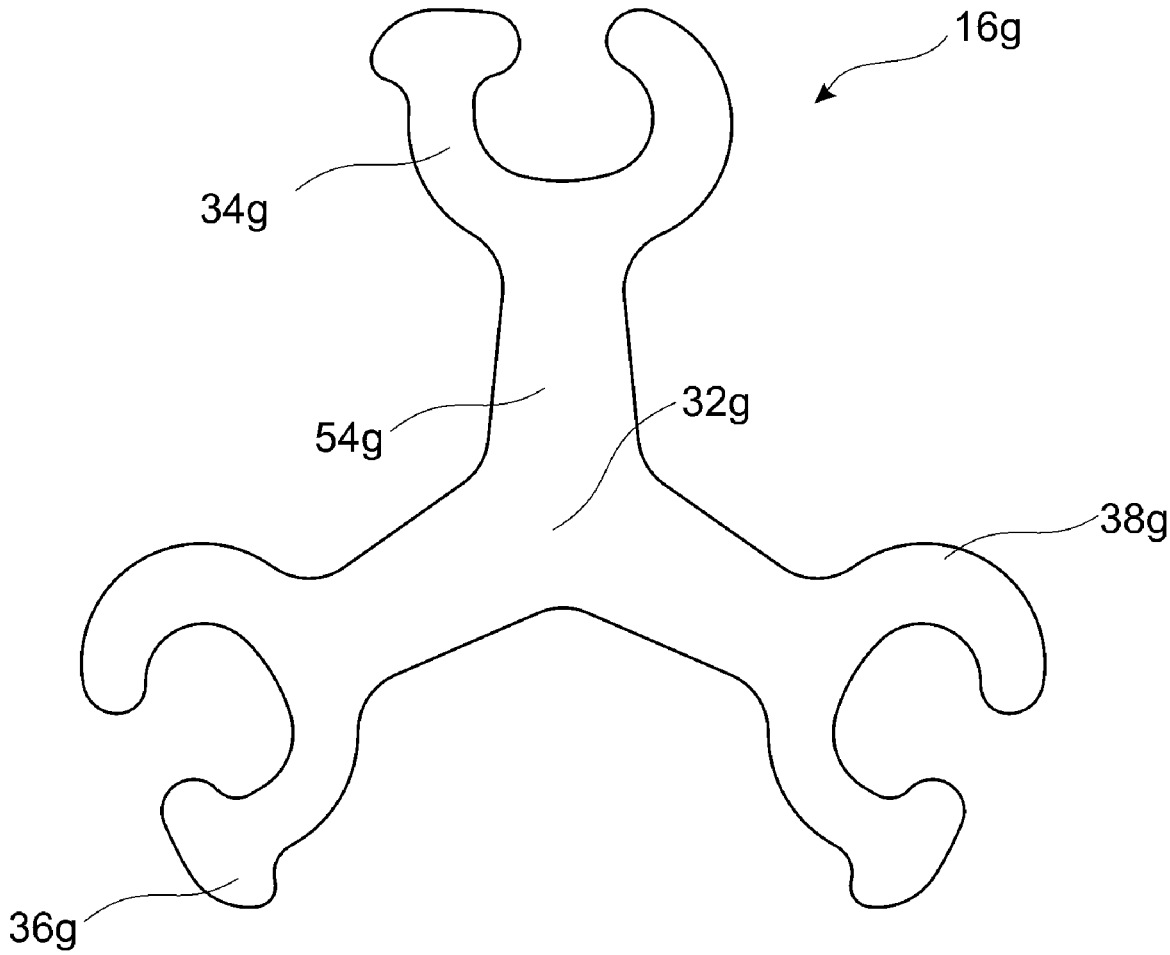
FIG. 14 is a plan view of a seventh modification of the exemplifying embodiment represented in FIGS. 6 and 7 wherein the base comprises three reinforced star-shaped ridge bars at the ends of which the lock profiles are formed.

FIG. 14 is a plan view representing a seventh modification 16*g* of the connecting profile 16 utilized for the arrangement 10 according to the invention, wherein the base 32*g* comprises three reinforced ridge bars 54*g* extending in a star configuration at the ends of which the lock profiles 34*g*, 36*g* and 38*g* are fashioned. The reinforcement of the ridge bars 54*g* prevents the lock profiles 34*g*, 36*g* and 38*g* from breaking under extreme tensile force.

Figure 15:
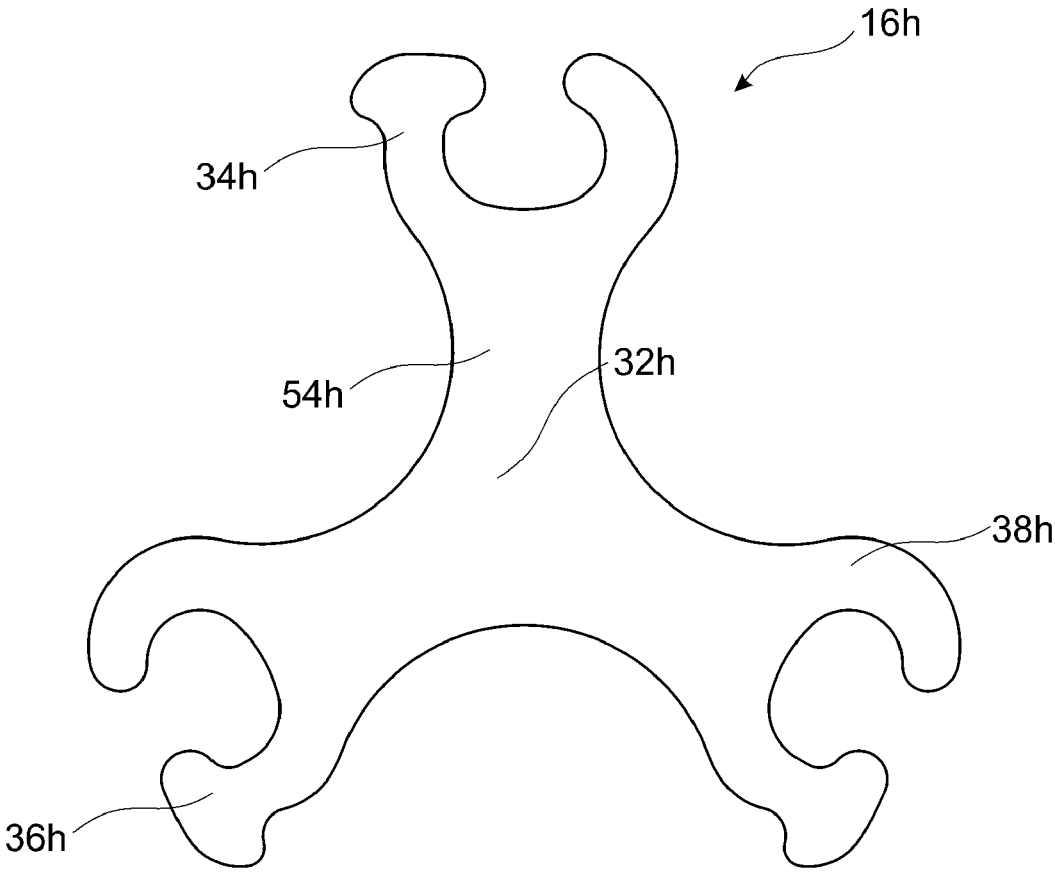
FIG. 15 is a plan view of an eighth modification of the exemplifying embodiment represented in FIGS. 6 and 7 wherein the base comprises three rounded and reinforced star-shaped ridge bars at the ends of which the lock profiles are formed.

Lastly, FIG. 15 is a plan view representing an eighth modification 16*h* of the connecting profile 16 utilized for the arrangement 10 according to the invention, wherein the base 32*h* comprises three rounded and reinforced ridge bars 54*h* extending in a star configuration at the ends of which the lock profiles 34*h*, 36*h* and 38*h* are fashioned. Here too the rounded shape is meant to improve the dissipation of stress.

The represented exemplifying embodiments are only some of the possible configurations. For instance, the base 32 can also be fashioned such that the lock profiles 34, 36 and 38 project in different directions of contact. That makes it possible to arrange the open cells 18 of the arrangement 10 at different angles relative to each other.

What is claimed is:

1. A sheet-pile wall assembly, comprising:

(a) an integrally-formed connecting profile having a solid central portion with three lock profiles arranged thereon, said connecting profile with its lock profiles defining a superficial center of gravity;

(b) two sheet-pile wall sections, wherein 1) each of the sheet-pile wall sections comprises a plurality of arcuately or polygonally arranged sheet-pile wall components that are joined together by means of locks at the ends thereof, and wherein 2) each of the sheet-pile wall sections is connected at a first end thereof to the connecting profile by means of a first end lock at one end of one of the sheet-pile wall components which is hooked into one of the lock profiles arranged on the connecting profile; and (c) an anchorage member with a lock at a first end thereof, wherein the anchorage member is connected to the connecting profile by means of the anchorage member lock being hooked into one of the lock profiles arranged on the connecting profile;

wherein the sheet-pile wall section-engaging lock profiles on the connecting profile and/or the first-end locks are configured such that the sheet-pile wall section-engaging lock profiles and the first-end locks engage each other with one component partially inside the other and with one component partially surrounding the other, there being at least three points at which the sheet-pile wall section-engaging lock profiles and the first-end locks contact and support each other;

wherein two of said three points of contact between each of said sheet-pile wall section-engaging lock profiles on the connecting profile and the first-end locks are arranged in a common circle;

wherein the anchorage member-engaging lock profile on the connecting profile and/or the lock at the first end of the anchorage member are/is configured such that the anchorage member-engaging lock profile and the lock at the first end of the anchorage member engage each other with one partially inside the other and with one partially surrounding the other, there being at least three points at which the anchorage member-engaging lock profile and the lock at the first end of the anchorage member contact and support each other; wherein each of the lock profiles on the connecting profile has at least one working point where a resulting tensile force impinges when one of the sheet-pile wall components or the anchorage member is hooked into and connected to it and extends in a direction of contact, the working points each being located at the same radial distance from the superficial center of gravity of the connecting profile;

wherein lines intersecting the superficial center of gravity and one of the working points of each of the sheet pile components and the anchorage are offset 120 degrees relative to one another;

wherein the lock profiles on the connecting profile each comprise 1) a thumb bar with a middle ridge at which a thumb is formed, with the thumb extending transverse to the longitudinal direction of the ridge and projecting beyond it, and 2) a curved finger bar having a free end which points toward the thumb bar, the thumb bar and the finger bar of each lock profile together defining an inner lock chamber with an at least approximately elliptical or oval profile as viewed in cross-section, with the end of the thumb of each lock profile being spaced from, and pointing toward, the end of the finger bar of each lock profile so as to define a mouth through which engaging portions of the first-end locks of the sheet-pile wall sections and the lock at the first end of the anchorage member enter the inner lock chamber; and wherein second ends of the sheet-pile wall sections are secured in their respective positions such that the two sheet-pile wall sections each partially enclose a region.

2. The sheet-pile wall assembly of claim 1, wherein each of the lock profiles on the connecting profile, as viewed in the cross-section of the connecting profile, forms a three point connection with the respective lock that is hooked into and engaged with it.

3. The sheet-pile wall assembly of claim 1, wherein the two sheet-pile wall engaging locks extend in mirror-symmetric fashion relative to the superficial center of gravity of the connecting profile.

4. The sheet-pile wall assembly of claim 1, further comprising a second connecting profile with lock profiles arranged thereon;

a third sheet-pile wall section having a lock at an end thereof; and a second anchorage member with a lock at an end thereof;

wherein the second end of one of said two sheet-pile wall sections has a lock by means of which said one of said two sheet-pile wall sections is hooked into and engaged with one of the lock profiles of the second connecting profile;

wherein the third sheet-pile wall section is hooked into and engaged with one of the lock profiles of the second connecting profile by means of the lock at the end of the third sheet-pile wall section; and wherein the second anchorage member is hooked into and engaged with one of the lock profiles of the second connecting profile by means of the lock at the end of the second anchorage member.

5. The sheet-pile wall assembly of claim 4, wherein a plurality of sheet-pile wall sections are provided, each of which comprises a plurality of arcuately or polygonally arranged sheet-pile wall components that are joined together by means of locks at the ends thereof;

wherein consecutive sheet-pile wall sections are joined together by means of connecting profiles; and wherein each connecting profile has joined to it an anchorage member that is secured in the ground.

6. The sheet-pile wall assembly of claim 1, wherein the anchorage member comprises a carrier element anchored in the ground.

7. The sheet-pile wall assembly of claim 6, wherein the carrier element is a double-T carrier, a T carrier, or a pipe pile.

8. The sheet-pile wall assembly of claim 6, wherein the carrier element is connected to the connecting profile by at least one sheet-pile wall component.

9. The sheet-pile wall assembly of claim 8, wherein said at least one sheet-pile wall component is a sheet pile.

10. The sheet-pile wall assembly of claim 1, wherein the partially enclosed regions are filled with soil while the sides of the sheet-pile wall sections that are averted from the surrounding area and that face outward protrude from the ground, whereby the sheet-pile wall sections holds back the soil contained in the surrounding area.

11. The sheet-pile wall assembly of claim 1, wherein the lock profiles on the connecting profile are configured such that the engaging locks of the sheet-pile wall sections and the anchorage member can each pivot by at least 15 degrees within the respective lock profile.

12. The sheet-pile wall assembly of claim 1, wherein at least one of the lock profiles on the connecting profile extends at an angle in a given direction of contact, as viewed in cross-section, such that the corresponding lock that is engaged with said at least one lock profile can be pivoted about the given direction of contact in a range of at least ±8 degrees to ±12 degrees.

13. The sheet-pile wall assembly of claim 12, wherein each of the lock profiles on the connecting profile extends at an angle of 5 to 10 degrees relative to a given direction of contact.

14. The sheet-pile wall assembly of claim 12, wherein each of the lock profiles on the connecting profile extends at an angle of 5 to 10 degrees relative to a given direction of contact thereof with a main axis of its inner lock chamber, the thumb bar being angled away from the given direction of contact.

15. The sheet-pile wall assembly of claim 1, wherein the connecting profile comprises a base with ridge bars projecting in a star configuration in the three directions of contact and wherein the lock profiles are formed, in part, at the ends of the ridge bars.

* * * * *